US006796253B2

(12) United States Patent
Kwon

(10) Patent No.: US 6,796,253 B2
(45) Date of Patent: Sep. 28, 2004

(54) APPARATUS FOR DRIVING EMBROIDERY FRAME

(75) Inventor: Tae Gun Kwon, Inchon (KR)

(73) Assignee: Sunstar Precision Co., Ltd., Inchon (KR)

( * ) Notice: Subject to any disclaimer, the term of this patent is extended or adjusted under 35 U.S.C. 154(b) by 0 days.

(21) Appl. No.: 10/601,549

(22) Filed: Jun. 24, 2003

(65) Prior Publication Data

US 2004/0016379 A1 Jan. 29, 2004

(30) Foreign Application Priority Data

Jun. 24, 2002 (KR) ..... 10-2000-0035360

(51) Int. Cl.[7] ..... D05C 5/02; D05B 21/00; D05B 25/00

(52) U.S. Cl. ..... 112/102.5; 112/470.18; 112/155

(58) Field of Search ..... 112/102.5, 470.18, 112/470.06, 470.14, 103, 155

(56) References Cited

U.S. PATENT DOCUMENTS 6,698,369 B2 * 3/2004 Kwak ..... 112/102.5

* cited by examiner

*Primary Examiner*—Peter Nerbun

(74) *Attorney, Agent, or Firm*—Greenblum & Bernstein, P.L.C.

(57) ABSTRACT

Disclosed is an apparatus for driving an embroidery frame of a multi-headed embroidery machine having a plurality of heads. Linear motors, for driving the embroidery frame in a direction of X-axis or Y-axis, are subdivided by their capacities so that they can be wired externally to prevent the deflection of the embroidery frame. The plurality of linear motors can be controlled simultaneously by means of a driver and a linear scale. The apparatus is characterized by an X-axis driving unit or a Y-axis driving units and an drive-control unit comprising: a linear motor section having a plurality of linear motors connected externally; a controller outputting a linear motor driving signal; a driver for driving the plurality of linear motors simultaneously by supplying a linear motor of the linear motor section with a driving current according to the linear motor driving signal from the controller; and a linear scale for feedback of an output signal, produced by the movement (degree of travel) of the linear motors, into the driver to control the movement of the linear motors actuated by the driver.

3 Claims, 10 Drawing Sheets

APPARATUS FOR DRIVING EMBROIDERY FRAME

BACKGROUND OF THE INVENTION

1. Field of the Invention

The present invention relates to an apparatus for driving an embroidery frame of an embroidery machine. More particularly, the present invention relates to an apparatus for driving an embroidery frame of a multi-headed embroidery machine having a plurality of heads, wherein linear motors, for driving the embroidery frame in a direction of X-axis or Y-axis, are subdivided by their capacities so that they can be connected externally to prevent the deflection of the embroidery frame and a plurality of linear motors can be controlled simultaneously by means of a driver and a linear scale.

2. Description of the Prior Art

The constitution and operation of a general embroidery machine will now be explained with reference to drawings.

As shown in FIGS. 1 and 2, an embroidery frame 4 is positioned on a table 2 having a rectangular shape. The table 2 has an X-axis slot 6 formed a determined length on its side along its longitudinal direction for guiding the embroidery frame 4 to move in the X-axis direction. The table 2 also has a Y-axis slot 8 formed a determined length on its rear side along its longitudinal direction for guiding the embroidery frame 4 to move in the Y-axis direction.

The embroidery frame 4 is provided with a beam 10 on its center portion. The beam 10 extends to the opposite ends of the table 2. The beam 10 is provided with a number of heads 12 arranged at an interval. The heads 12 comprise a plurality of needles. The number of heads 12 corresponds to the number of locations where embroidery is to be performed. The heads 12 are connected with a main-axis driving unit 16 positioned below the table 2 at the other side for transmitting power.

The embroidery frame 4 is also provided with an X-axis driving unit 17 on its side for supplying power necessary for the movement (forward or backward) of the embroidery frame 4 in the X-axis direction. The X-axis driving unit 17 will now be described in detail with reference to FIGS. 3 and 4.

The X-axis driving unit 17 has a roller 18 positioned at a side of the embroidery frame 4 rotatably. The roller 18 engages with a front portion of a first connector frame 20 for moving the embroidery frame 4 in the X-axis direction. The first connector frame 20 has a guide groove 22 formed on its front face in its longitudinal direction for guiding the roller 18 to slide in the Y-axis direction.

The first connector frame 20 is engaged with an upper end of a supporter 24 at its lower portion. The supporter 24 slides within the X-axis slot 6 and is provided with a linear motor 26 at its lower end for supplying power necessary for the movement of the embroidery frame 4 in the X-axis direction. The linear motor 26 is connected with a control unit 28 for controlling the actuation thereof. The controller unit 28 is positioned below the table 2.

The control unit 28 is connected with an operation unit 30 for providing an operator with a menu necessary for selecting shapes and colors during embroidery.

There are various types of linear motors 26. However, the constitution of a linear motor 26 most suitable for the embodiments of the present invention will be described in the following.

The linear motor 26 is provided with a rack base 34 having a magnet 32 positioned in the longitudinal direction.

The rack base 34 is interposed by rails 36 acting as guides. A slider 38 is placed on top of the rails 36. The slider 38 can move in the forward or backward direction. The slider 38 is provided with a coil (not shown) beneath its bottom surface. The coil opposes the magnet 32 and generates a magnet field when supplied with electric currents.

Meanwhile, the embroidery frame 4 is provided with a Y-axis driving unit 39 on its rear end, as shown in FIGS. 5 and 6. The Y-axis driving unit 39 can move forward or backward in the Y-axis direction. The constitution of the Y-axis driving unit 39 will be described below.

The Y-axis driving unit 39 has a second connector frame 40 positioned at the rear end of the embroidery frame 4. The second connector frame 40 is provided with a slide rib 42 on its rear surface. The slide rib 42 protrudes vertically from the rear surface and extends along the longitudinal direction.

A supporter 44 is positioned below the lower end of the second connector frame 40. The supporter 44 can move forward or backward along the Y-axis slot 8. The supporter 44 is provided with two guide rollers 46 on its upper end. The guide rollers 46 can rotate and act as guides while making slip contact with opposite sides of the slide rib 42. A support roller 48 is placed between the guide rollers 46. The support roller 48 can rotate and acts a guide while supporting the lower end of the slide rib 42.

Furthermore, a linear motor 50 is positioned on the lower end of the supporter 44 for supplying the embroidery frame 4 with power necessary for its Y-axis movement. The constitution of the linear motor 50 is identical to that of the linear motor 26 described above.

Of course, the Y-axis driving unit 39 may be positioned on the front end of the embroidery frame 4, if necessary.

Meanwhile, in the case of an embroidery machine as mentioned above, a drive-control unit controls the X-axis and Y-axis driving units 17 and 39 for moving the embroidery frame 4 in the X-axis and Y-axis directions, respectively. The drive-control unit will now be described with reference to FIG. 7.

An embroidery machine is a two-axis positioning controller which controls the horizontal movement of an embroidery frame 4, having materials to be sewn (fabrics) fixed thereon, in the X-axis and Y-axis directions, during vertical movement of a needle bar of a sewing machine capable of performing needlework. Conventionally, linear AC servomotors have been used as apparatuses for driving embroidery machines.

An embroidery frame 4 of a multi-headed embroidery machine is positioned on top of a movable block of a linear motor 210 for interlocked movement. The embroidery frame 4 is generally made of aluminum. If only one linear motor 210 is used to actuate the embroidery frame 4, the embroidery frame 4 tends to be deflected at its opposite ends as the length of the multi-headed embroidery machine becomes larger in the X-axis direction, although the embroidery frame 4 is supposed to move horizontally in the X-axis and Y-axis directions.

For such reasons, it has been generalized to use a plurality of driving apparatuses, not a single driving apparatus, as Y-axis driving apparatuses in the case of multi-headed embroidery machines.

The drive-control unit will now be described in detail.

FIG. 7*a* show a configuration of a driving unit of an embroidery frame according to the prior art, FIG. 7*b* shows an outer appearance of a movable block of a linear motor, and FIG. 7*c* shows a coil connection diagram.

As shown in FIG. 7*a*, a Y-axis driving unit comprises a plurality of (four) linear motors 210, a plurality of (four) drivers 220, and a plurality of (four) linear scales 230. The Y-axis driving unit is controlled by a synchronized signal from a controller 240.

As shown in FIG. 7*b*, three-phase, i.e., u, v and w phase windings and an earth wire G are drawn out from a movable block. The remaining wires are molded within the movable block.

FIG. 7*c* shows a coil connection within the movable block. In the case of a Y-connection linear motor, one ends of each of the u, v and w phase windings are connected and molded within the movable block and the other ends and drawn out from the movable block for use.

Even when a plurality of linear motors 210 are controlled simultaneously by means of capacity-division, as in the case of a multi-headed embroidery machine, each of the linear motors 210 should by provided with a driver 220 and a linear scale 230 separately.

In other words, the number of drivers 220 and linear scales 230 must be equal to that of linear motors 210.

This is due to a fact that finished linear motors have been used when applying linear motors to apparatuses for driving embroidery machines. High price of linear motors and subsidiaries results in the problem of increased manufacturing cost.

Considerable errors also happen because, according to the prior art, the control unit is formed by each of the linear scales.

SUMMARY OF THE INVENTION

Accordingly, the present invention has been made to solve the above-mentioned problems occurring in the prior art, and an object of the present invention is to provide an apparatus for driving an embroidery frame wherein six wires are drawn out from a movable block for use so that a plurality of linear motors can be connected externally.

Another object of the present invention is to provide an apparatus for driving an embroidery frame wherein a plurality of linear motors, externally connected as mentioned above, can be controlled simultaneously by means of a driver and a controller.

In order to accomplish these objects, according to an embodiment of the present invention, there is provided an apparatus for driving an embroidery frame of a multi-headed embroidery machine including an embroidery frame for holding fabrics, a plurality of heads having a plurality of needles, an X-axis driving unit for supplying the embroidery frame with power necessary for movement in the X-axis direction, a Y-axis driving unit for supplying the embroidery frame with power necessary for movement in the Y-axis direction, and a drive-control unit for outputting X-axis and Y-axis drive-control signals to control the X-axis and Y-axis driving units, respectively, characterized by the X-axis driving unit or the Y-axis driving units and the drive-control unit comprising: a linear motor section having a plurality linear motors connected externally; a controller outputting a linear motor driving signal; a driver for driving the plurality of linear motors simultaneously by supplying a linear motor of the linear motor section with a driving current according to the linear motor driving signal from the controller; and a linear scale for feedback of an output signal, produced by the movement (degree of travel) of the linear motors, into the driver to control the movement of the linear motors actuated by the driver.

Preferably, each of the linear motors of the linear motor section comprises a movable block and both ends of the windings within the movable block are drawn out.

More preferably, the linear motors of the linear motor section are connected in series or in parallel as an Y-connection.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
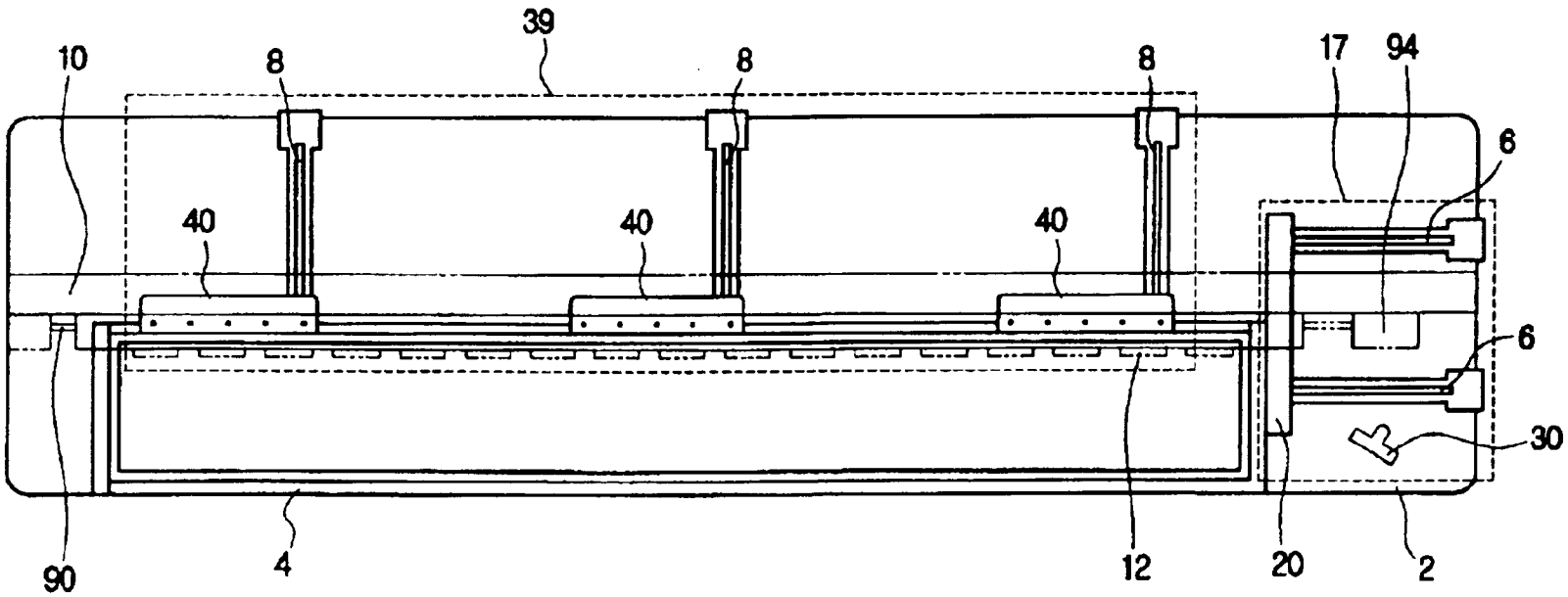
FIG. 1 PRIOR ART
FIG. 1 is a plan view of an embroidery machine according to the prior art.
Figure 2:
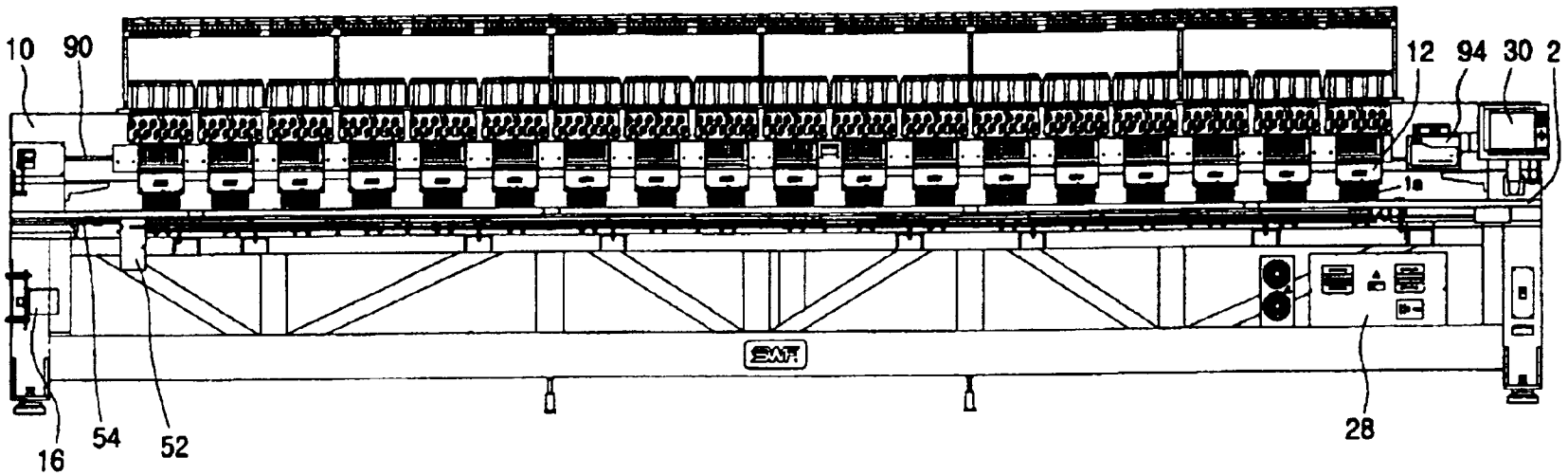
FIG. 2 PRIOR ART
FIG. 2 is a front view of an embroidery machine according to the prior art.
Figure 3:
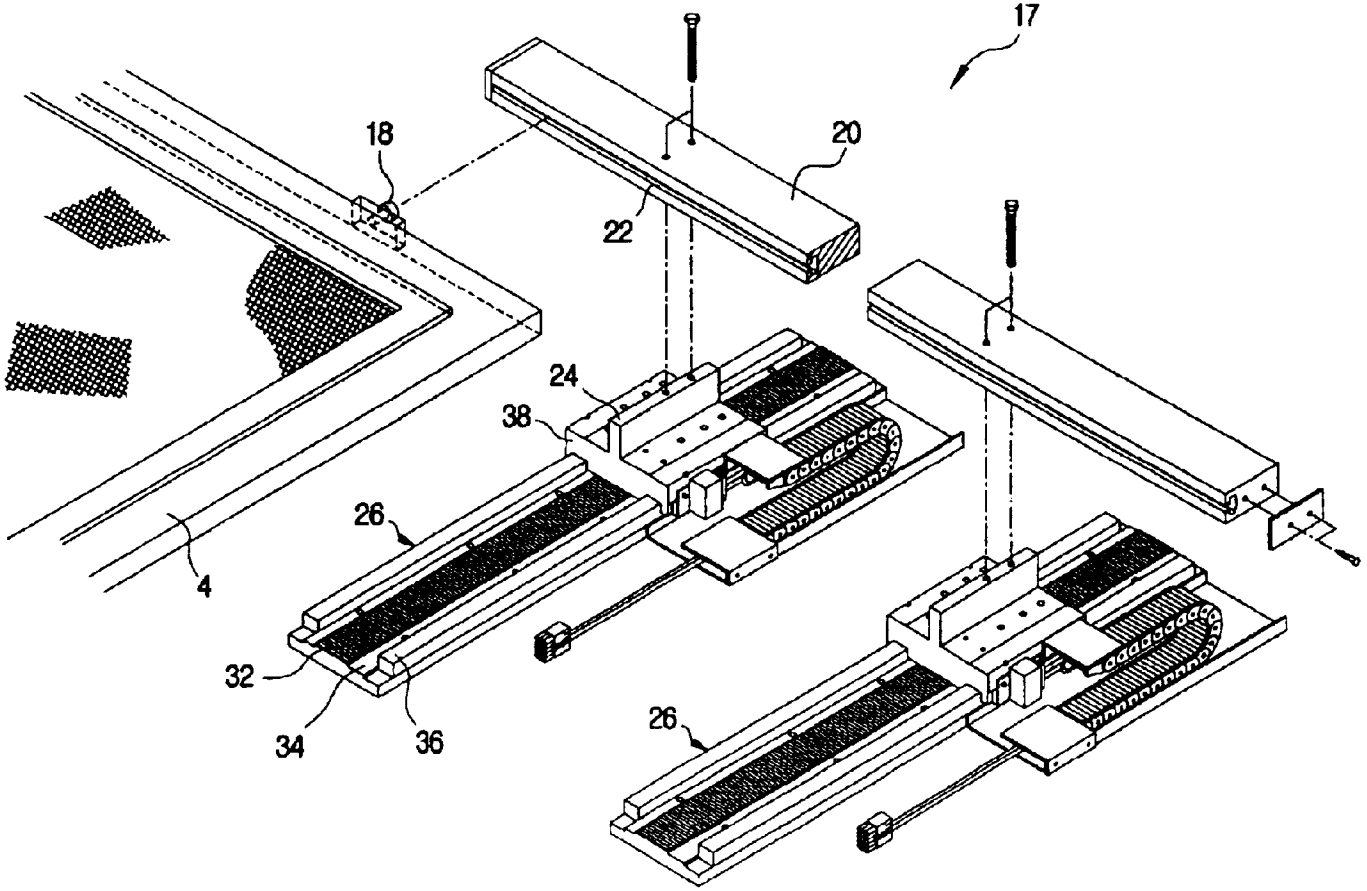
FIG. 3 PRIOR ART
FIG. 3 is a perspective view of an exploded X-axis driving unit according to the prior art.
Figure 4:
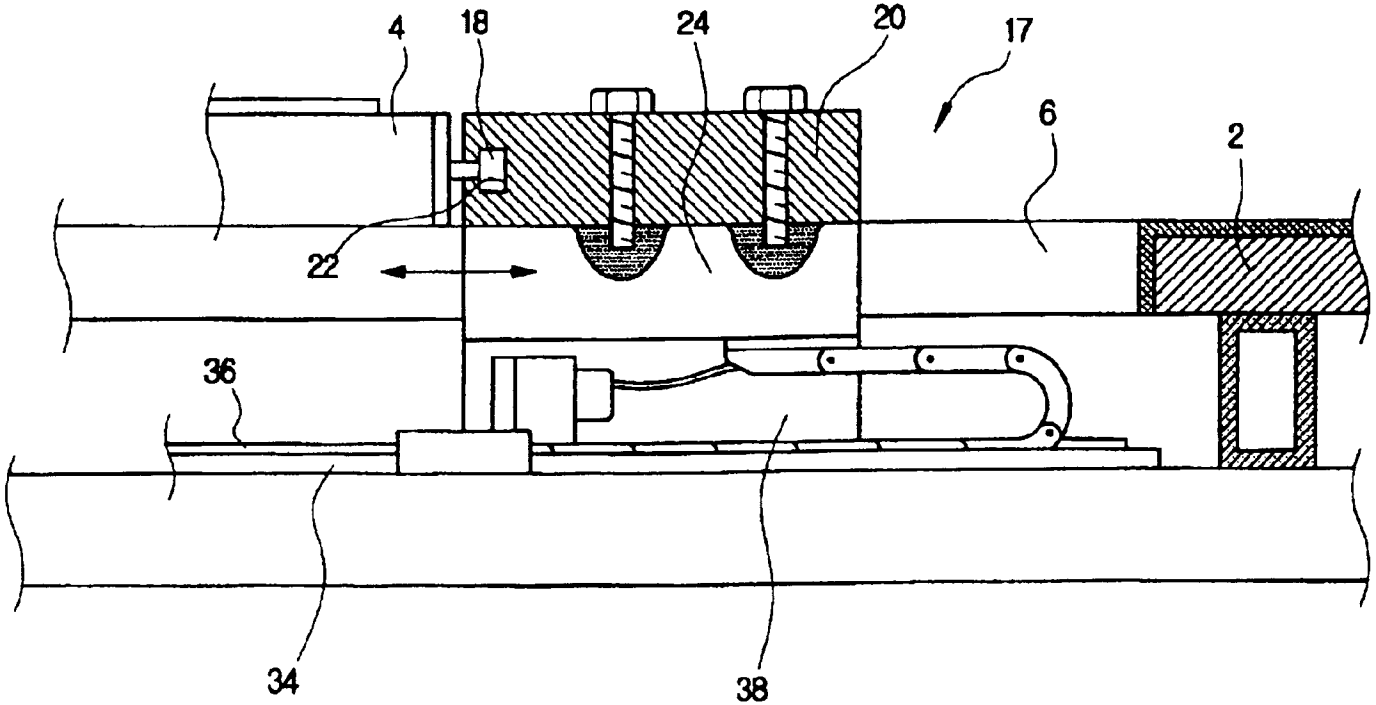
FIG. 4 PRIOR ART
FIG. 4 is a sectional view of an assembled X-axis driving unit according to the prior art.
Figure 5:
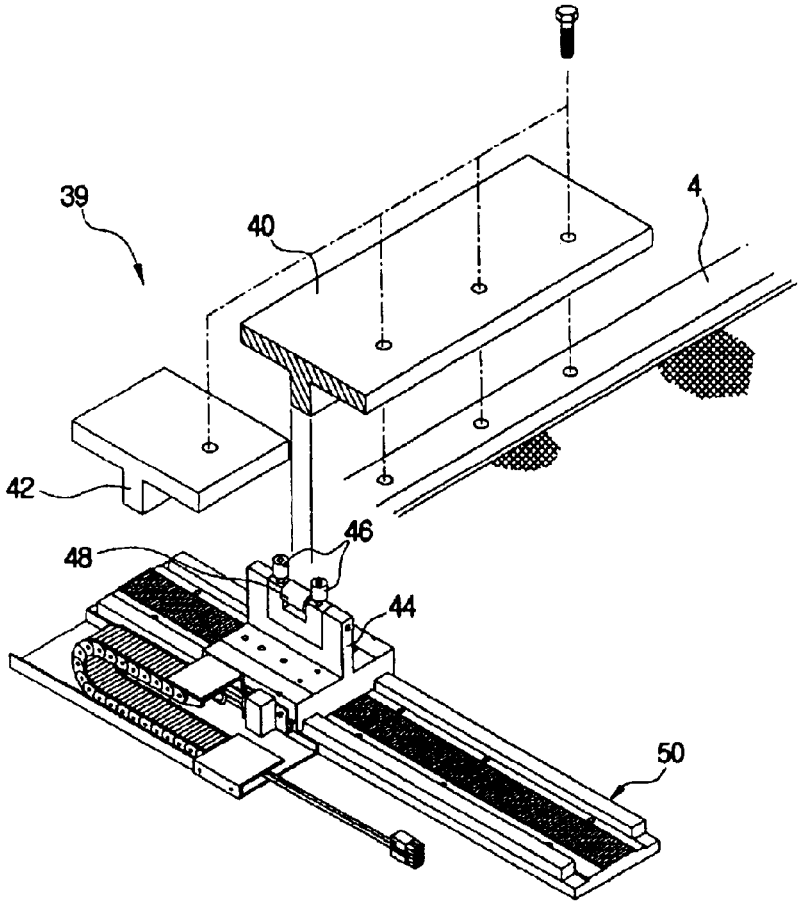
FIG. 5 PRIOR ART
FIG. 5 is a perspective view of an exploded Y-axis driving unit according to the prior art.
Figure 6:
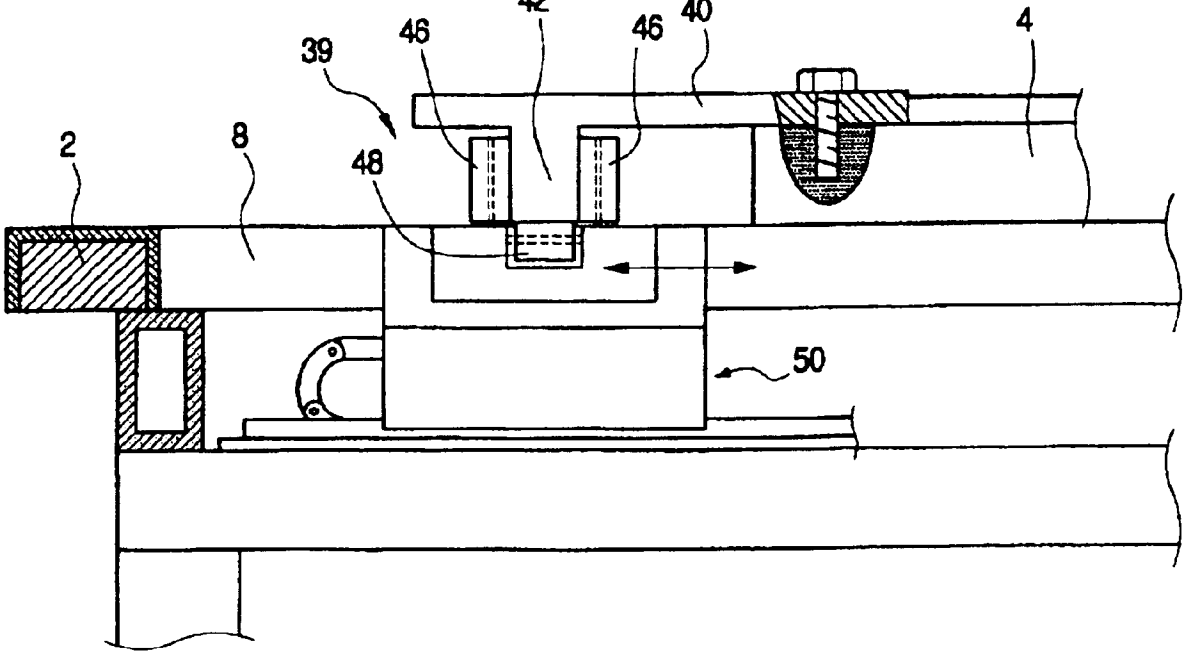
FIG. 6 PRIOR ART
FIG. 6 is a sectional view of an assembled Y-axis driving unit according to the prior art.
Figure 7A:
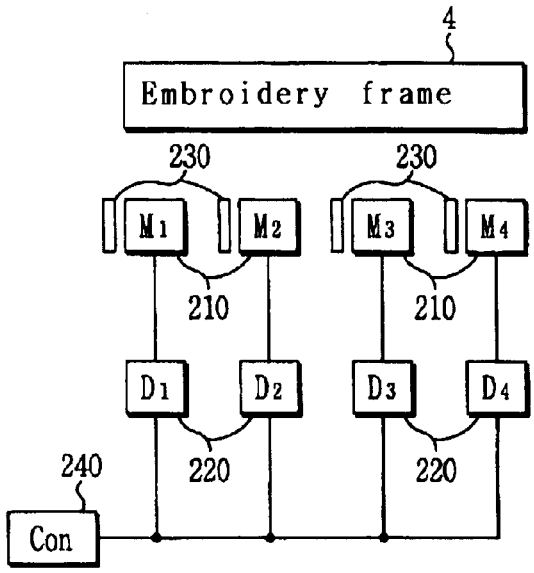
FIG. 7a PRIOR ART
FIG. 7*a* shows a configuration of an embroidery frame driving unit and a drive-control unit according to the prior art.
Figure 7B:
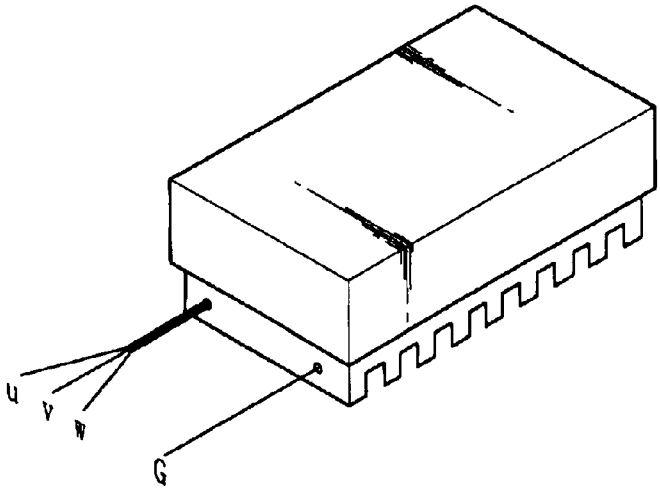
FIG. 7b PRIOR ART
FIG. 7*b* shows an outer appearance of a movable block of a linear motor.
Figure 7C:
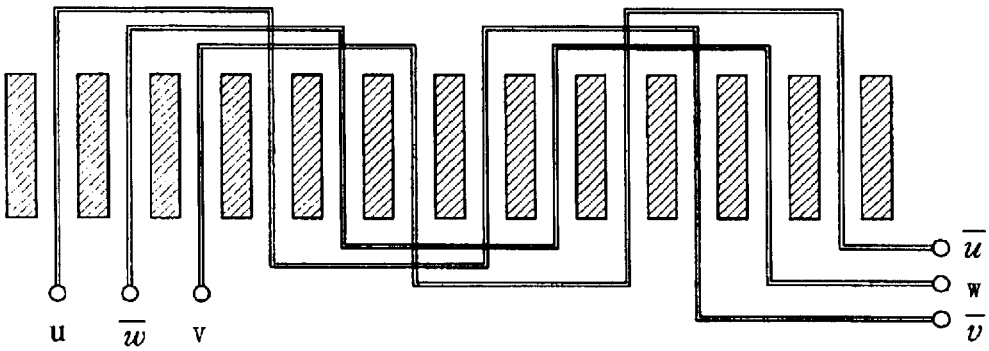
FIG. 7c PRIOR ART
FIG. 7*c* is a coil connection diagram.

Hereinafter, a preferred embodiment of the present invention will be described with reference to the accompanying drawings. In the following description and drawings, the same reference numerals are used to designate the same or similar components, and so repetition of the description on the same or similar components will be omitted.

A driving unit and a drive-control unit according to an embodiment of the present invention, distinguished from the prior driving unit and drive-control unit as described above, will now be described with reference to FIGS. 8 and 9.

Figure 8A:
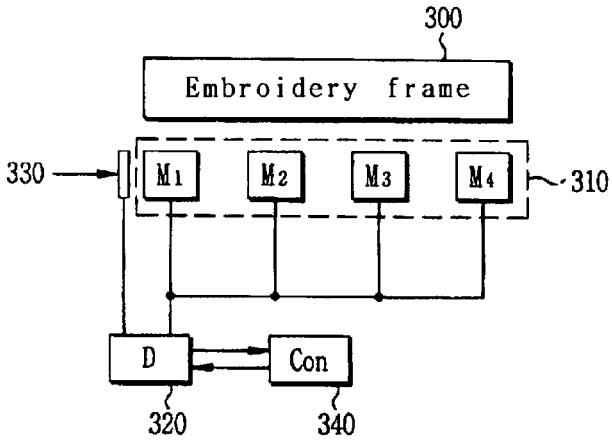
FIG. 8*a* shows a configuration of an embroidery frame driving unit and a drive-control unit according to the present invention.
Figure 8B:
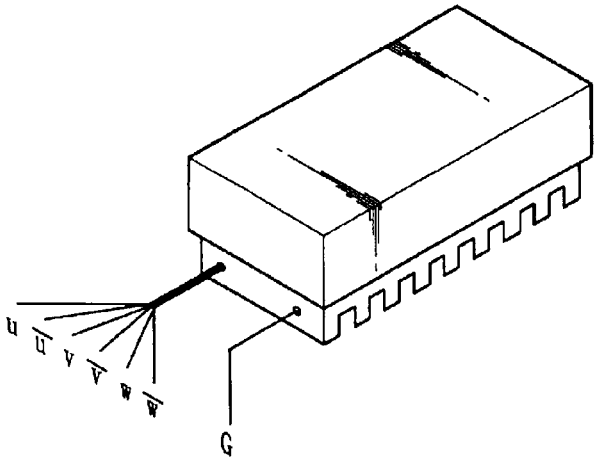
FIG. 8*b* shows an outer appearance of a movable block of a linear motor.
Figure 8C:
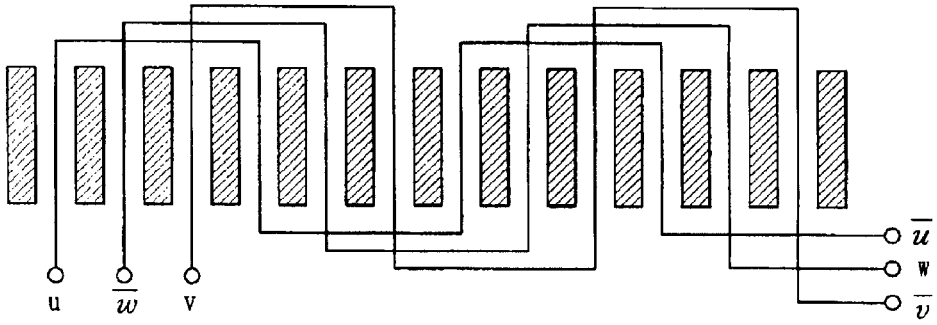
FIG. 8*c* is a coil connection diagram.

FIG. 8*a* shows a configuration of an embroidery frame driving unit and a drive-control unit according to an embodiment of the present invention wherein a plurality of linear motors are connected in series as a Y-connection, FIG. 8*b* shows an outer appearance of a movable block, and FIG. 8*c* shows an embodiment of a coil connection diagram.

Referring to FIG. 8*a*, the driving unit and the drive-control unit according to the present invention comprise: a linear motor section 310 having a plurality of linear motors connected externally; a controller 340 outputting a linear motor driving signal; a driver 320 for driving the plurality of linear motors simultaneously by supplying a linear motor of the linear motor section 310 with a driving current according to the linear motor driving signal from the controller 340; and a linear scale 330 for feedback of an output signal, produced by the movement (degree of travel) of the linear motors, into the driver 320 to control the movement of the linear motors actuated by the driver.

The constitution of the driving unit and the drive-control unit can be applied to an X-axis driving unit only, to a Y-axis driving unit only, or to both the X-axis and Y-axis driving units. For example, one linear motor may be used in the X-axis driving unit while a plurality of linear motors may be used in the Y-axis driving unit. Alternatively, a plurality of linear motors may be used in both the X-axis and Y-axis driving units.

Each of the linear motors of the linear motor section 310 comprises a movable block as a linear-movement (i.e., moving along a straight line) motor.

As described above, in the case of a movable block of a linear motor according to the prior art, three windings u, v, w are drawn out from the movable block, while three windings $\bar{u}$, $\bar{v}$, $\bar{w}$ are molded in the movable block. However, according to the present invention, all of six windings u, v, w, $\bar{u}$, $\bar{v}$, $\bar{w}$ are drawn out, as shown in FIG. 8, so that they can be used for an external Y-connection with an adjacent linear motor.

The reference character "G" in FIG. 8*b* represents an earth wire.

According to the constitution as shown in FIG. 8*a*, only one driver 320 and only one linear scale 330 will be enough, since four linear motors $M_1$, $M_2$, $M_3$, $M_4$ are connected in series.

That is, one controller 340 can control the four linear motors $M_1$, $M_2$, $M_3$, $M_4$ connected in series simultaneously by means of one driver 320. One linear scale 330 is enough for one driver.

When the linear motors $M_1$, $M_2$, $M_3$, $M_4$ are to be actuated, the controller 340 outputs a signal ordering the driver 320 to supply a driving current. Likewise, when the linear motors $M_1$, $M_2$, $M_3$, $M_4$ are to be stopped, the controller 320 outputs a signal ordering the driver to stop supplying the driving current.

FIG. 8*c* shows a coil connection of a movable block. Six windings shown in FIG. 8*c* are drawn out from the movable block, as shown in FIG. 8*b*.

Figure 9:
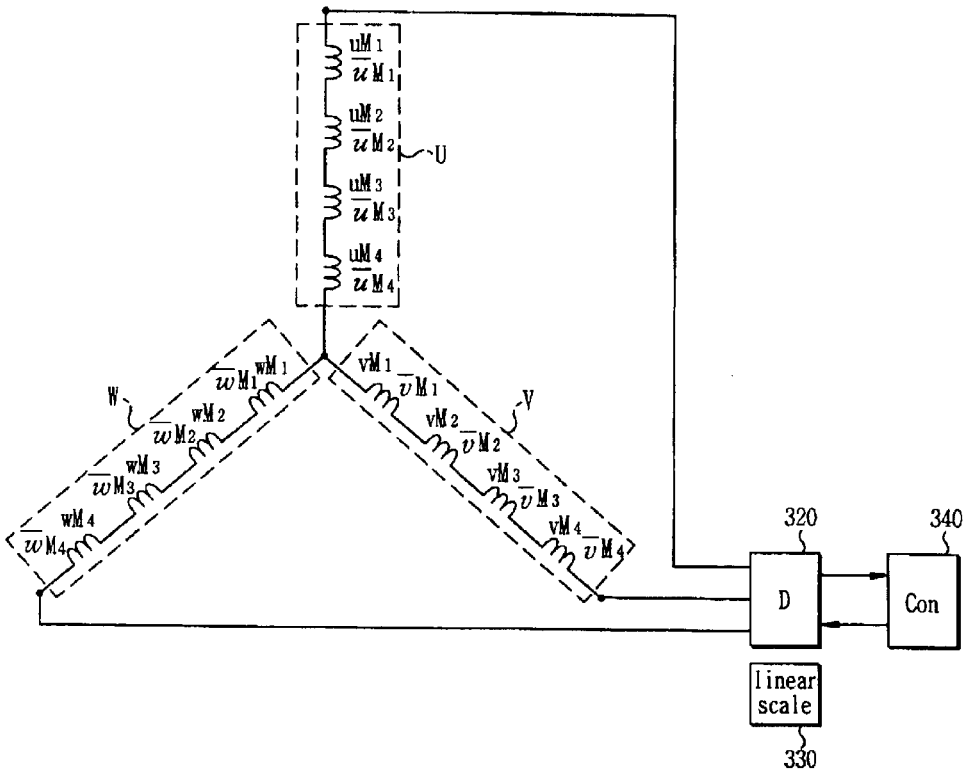
FIG. 9 shows an equivalent circuit according to an embodiment of a Y-connection of linear motors.

FIG. 9 shows an equivalent circuit wherein each of the windings, drawn out from the movable block, is in series connection with the linear motors $M_1$, $M_2$, $M_3$, $M_4$.

Specifically, u and $\bar{u}$ of linear motor $M_1$, u and $\bar{u}$ of linear motor $M_2$, and u and $\bar{u}$ of linear motor $M_3$ are coupled together, respectively, to form a series connection U. Similarly, v and $\bar{v}$ of linear motor $M_1$, v and $\bar{v}$ of linear motor $M_2$, and v and $\bar{v}$ of linear motor $M_3$ are coupled together, respectively, to form a series connection V. Finally, w and $\bar{w}$ of linear motor $M_1$, w and $\bar{w}$ of linear motor $M_2$, w and $\bar{w}$ of linear motor $M_3$ are coupled together, respectively, to form a series connection W. The series connections U, V, w are then connected in series as a Y-connection, as shown in FIG. 9.

When four linear motors are connected in series as a Y-connection, the total power for driving an embroidery frame 300 is equal to the sum of the capacities of four linear motors 310. Four linear motors 310 can be simultaneously controlled by means of a driver 320 and a linear scale 330.

As explained above, according to the present invention, six wirings are drawn out from three-phase windings of a movable block in a linear motor so that a plurality of linear motors can be connected externally. Therefore, a drive-control unit can control a plurality of linear motors simultaneously in a stable manner by means of a driver and a linear scale.

The external connection of a plurality of linear motors makes the constitution of the drive-control unit simpler, as well as decreases the manufacturing cost of an embroidery frame driving apparatus.

Furthermore, the present invention reduces the number of components, such as drivers and linear scales of drive-control units. This saves the space for mounting motors and provides a simpler mechanical structure. Such a structure is easy to operate during a technical support.

Finally, the capacity of the apparatus for driving an embroidery frame according to the present invention can be increased or decreased easily in accordance with the size of the embroidery machine, because a plurality of linear motors can be connected externally.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An apparatus for driving an embroidery frame of a multi-headed embroidery machine including an embroidery frame for holding fabrics, a plurality of heads having a plurality of needles, an X-axis driving unit for supplying the embroidery frame with power necessary for movement in the X-axis direction, a Y-axis driving unit for supplying the embroidery frame with power necessary for movement in the Y-axis direction, and a drive-control unit for outputting X-axis and Y-axis drive-control signals to control the X-axis and Y-axis driving units respectively, characterized by the X-axis driving unit or the Y-axis driving units and the drive-control unit comprising:

a linear motor section having a plurality of linear motors connected externally;

a controller outputting a linear motor driving signal;

a driver for driving the plurality of linear motors simultaneously by supplying a linear motor of the linear motor section with a driving current according to the linear motor driving signal from the controller; and a linear scale for feedback of an output signal, produced by the movement (degree of travel) of the linear motors, into the driver to control the movement of the linear motors actuated by the driver.

2. The apparatus as claimed in claim 1, wherein each of the linear motors of the linear motor section comprises a movable block and both ends of the windings within the movable block are drawn out.

3. The apparatus as claimed in claim 1, wherein the linear motors of the linear motor section are connected in series or in parallel as a Y-connection.

* * * * *

UNITED STATES PATENT AND TRADEMARK OFFICE

CERTIFICATE OF CORRECTION

PATENT NO. : 6,796,253 B2
DATED : September 28, 2004
INVENTOR(S) : T.G. Kwon

It is certified that error appears in the above-identified patent and that said Letters Patent is hereby corrected as shown below:

Title page,
Item [30], Foreign Application Priority Data, "10-2000" should be -- 10-2002 --.

Signed and Sealed this

Twelfth Day of July, 2005

JON W. DUDAS
*Director of the United States Patent and Trademark Office*